US009181003B2

(12) United States Patent
Frisch et al.

(10) Patent No.: US 9,181,003 B2
(45) Date of Patent: Nov. 10, 2015

(54) DISPENSER WITH RUPTURE MEMBER

(75) Inventors: Kathleen Frisch, Belle Mead, NJ (US); Peter R. Hilliard, Jr., Far Hills, NJ (US); Peter M. Stagl, Morris Plains, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/009,002

(22) PCT Filed: Apr. 21, 2011

(86) PCT No.: PCT/US2011/033399

§ 371 (c)(1), (2), (4) Date: Sep. 30, 2013

(87) PCT Pub. No.: WO2012/145003

PCT Pub. Date: Oct. 26, 2012

(65) Prior Publication Data

US 2014/0034669 A1 Feb. 6, 2014

(51) Int. Cl.

| | |
|---|---|
| ***B67D 1/00*** | (2006.01) |
| ***B65D 47/10*** | (2006.01) |
| ***B65D 23/04*** | (2006.01) |
| ***B65D 47/06*** | (2006.01) |
| ***B65D 81/32*** | (2006.01) |

(52) U.S. Cl.

CPC ..... *B65D 47/103* (2013.01); *B65D 23/04* (2013.01); *B65D 47/06* (2013.01); *B65D 81/32* (2013.01)

(58) Field of Classification Search

CPC .... B65D 35/242; B65D 47/103; B65D 81/32; B65D 23/04; B65D 47/06; B01F 15/0205; B01F 5/0693

USPC ..... 222/459, 564, 80–87; 239/398

See application file for complete search history.

(56) References Cited

U.S. PATENT DOCUMENTS

| | | | | |
|---|---|---|---|---|
| 3,110,424 | A | 11/1963 | Winchell | |
| 3,688,846 | A | 9/1972 | Lease | |
| 4,201,316 | A | 5/1980 | Klingaman | |
| 4,961,727 | A | 10/1990 | Beard | |
| 5,154,321 | A * | 10/1992 | Shomer | 222/129 |
| 5,244,121 | A | 9/1993 | Shomer | |
| 6,045,813 | A | 4/2000 | Ferguson et al. | |

(Continued)

FOREIGN PATENT DOCUMENTS

| | | |
|---|---|---|
| DE | 20 2007 011669 | 6/2008 |
| JP | H02282311 | 11/1990 |

OTHER PUBLICATIONS

International Search Report and the Written Opinion of the International Searching Authority issued in PCT/US2011/033399 mailed Oct. 21, 2011.

*Primary Examiner* — Kevin P Shaver
*Assistant Examiner* — Robert Nichols, II

(57) ABSTRACT

A dispenser (100) having a reservoir (210) containing a composition (211) comprising a first substance (220) and at least one bead (230) immersed in the first substance, the bead comprising a shell (231) containing a second substance (232); a dispensing conduit (320) for dispensing the composition from the reservoir; and a rupture member (330) disposed within the dispensing conduit, the rupture member comprising at least one aperture (331 A-C) and at least one barb (332) extending into the aperture, the at least one barb rupturing the shell of the at least one bead as the composition flows through the at least one aperture.

28 Claims, 8 Drawing Sheets

(56) References Cited

U.S. PATENT DOCUMENTS

| | | | | |
|---|---|---|---|---|
| 6,454,130 | B1 | 9/2002 | Miller et al. | |
| 6,550,647 | B1 | 4/2003 | Kunz | |
| 7,225,920 | B2 | 6/2007 | Hoeffkes et al. | |
| 7,258,251 | B2 | 8/2007 | Johnson | |
| 7,284,902 | B2 * | 10/2007 | Hosozawa | 366/336 |
| 7,823,723 | B2 | 11/2010 | Anthony et al. | |
| 7,882,976 | B1 * | 2/2011 | Goede | 220/258.1 |
| 2003/0084914 | A1 | 5/2003 | Simon | |
| 2006/0147250 | A1 | 7/2006 | Tereschouk | |
| 2008/0110929 | A1 | 5/2008 | Stanley et al. | |
| 2008/0234507 | A1 | 9/2008 | Petit et al. | |
| 2009/0152281 | A1 | 6/2009 | Bowes et al. | |

* cited by examiner

DISPENSER WITH RUPTURE MEMBER

CROSS-REFERENCE TO RELATED PATENT APPLICATIONS

The present application is a U.S. national stage application under 35 U.S.C. §371 of PCT Application No. PCT/US2011/033399, filed Apr. 21, 2011. The disclosure of the above application is incorporated herein by reference.

FIELD OF THE INVENTION

The present invention relates to dispensers, and specifically to dispensers containing a person care or home care composition comprising suspended beads that are ruptured within a dispensing conduit of the dispenser.

BACKGROUND OF THE INVENTION

Personal care and home care products having a liquid composition having beads containing a second composition suspended therein are known. In such products, there is an issue as to how to release the second composition from the bead. If the bead is too frangible, then the agent will react with the liquid composition. If the bead is too hard, then the bead may simply fail to rupture during use and wash away. Moreover, for various reasons, it may be desirable to rupture (or preweaken) the beads during the dispensing of the product from the dispenser.

Therefore, a need exists for a dispenser that can rupture beads suspended within a first substance during the dispensing of the product.

BRIEF SUMMARY OF THE INVENTION

The present invention, in one aspect, is directed to a dispenser containing a composition having a first substance and beads containing a second substance that are suspended within the first substance. The dispensing conduit of the dispenser is configured to rupture the beads during dispensing of the composition.

According to one embodiment, the invention can be a dispenser comprising: a reservoir containing a composition comprising a first substance and at least one bead immersed in the first substance, the bead comprising a shell containing a second substance; a dispensing conduit for dispensing the composition from the reservoir; and a rupture member disposed within the dispensing conduit, the rupture member comprising at least one aperture and at least one barb extending into the aperture, the at least one barb rupturing the shell of the at least one bead as the composition flows through the at least one aperture.

According to another embodiment, the invention can be a dispenser comprising: a reservoir containing a composition comprising a first substance and a plurality of beads immersed in the first substance, each of the beads comprising a shell containing a second substance; a dispensing conduit for dispensing the composition from the reservoir; and a flow-restrictor disposed within the dispensing conduit, the flow-restrictor comprising a plurality of apertures and a plurality of barbs extending into each of the apertures, the barbs rupturing the shells of the beads as the composition flows through the apertures.

According to yet another embodiment, the invention can be a dispensing apparatus comprising: a conduit; and a flow-restrictor disposed within the conduit, the flow-restrictor comprising: at least one aperture; and a plurality of barbs extending into the at least aperture, wherein the barbs are arranged in at least one saw-toothed configuration.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
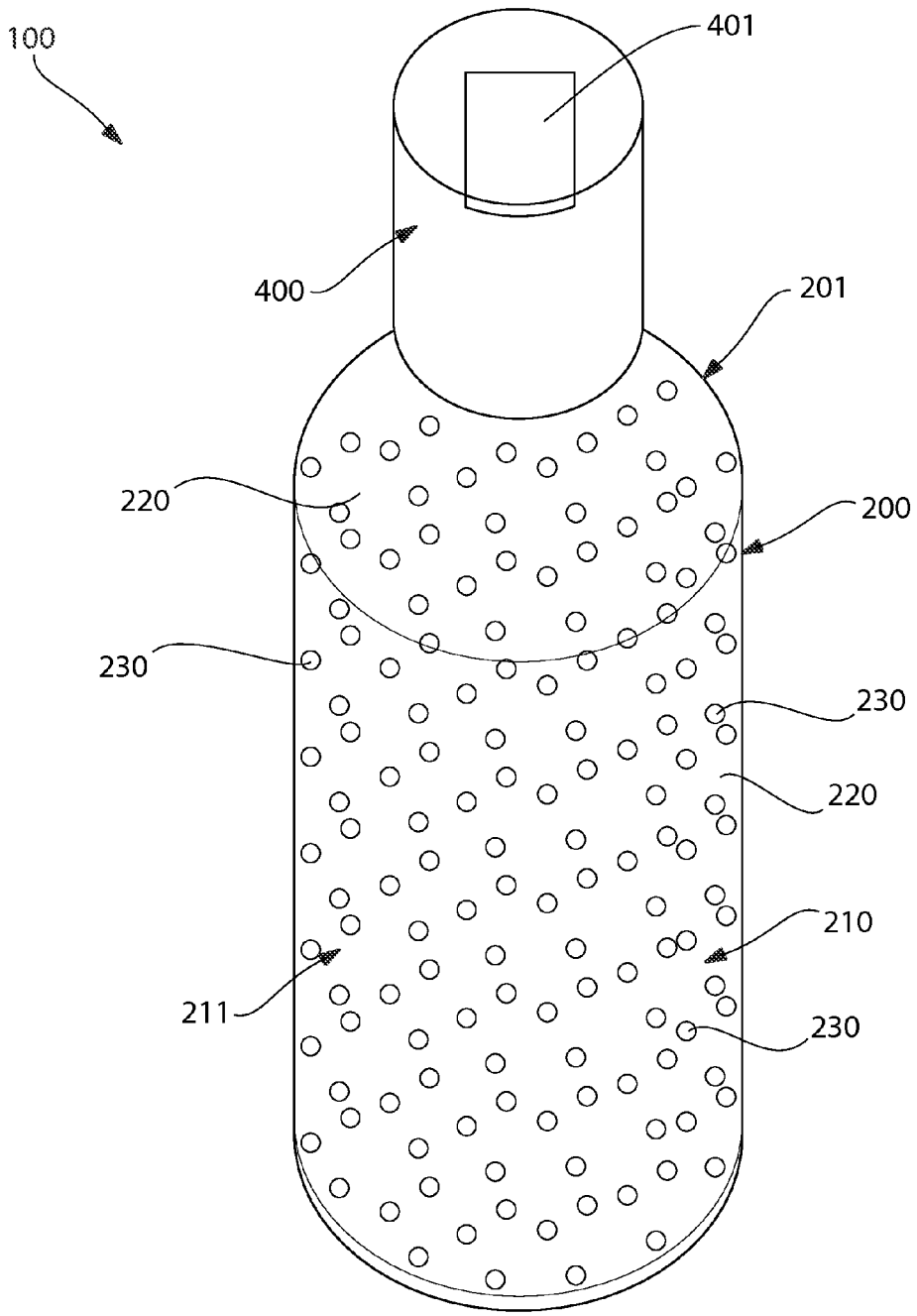
FIG. 1 is a perspective view of a dispenser according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

In the description of embodiments of the invention disclosed herein, any reference to direction or orientation is merely intended for convenience of description and is not intended in any way to limit the scope of the present invention. Moreover, the features and benefits of the invention are illustrated by reference to exemplified embodiments. Accordingly, the invention expressly should not be limited to such exemplified embodiments illustrating some possible but non-limiting combination of features that may be provided alone or in other combinations of features; the scope of the invention being defined by the claims appended hereto.

Figure 2:
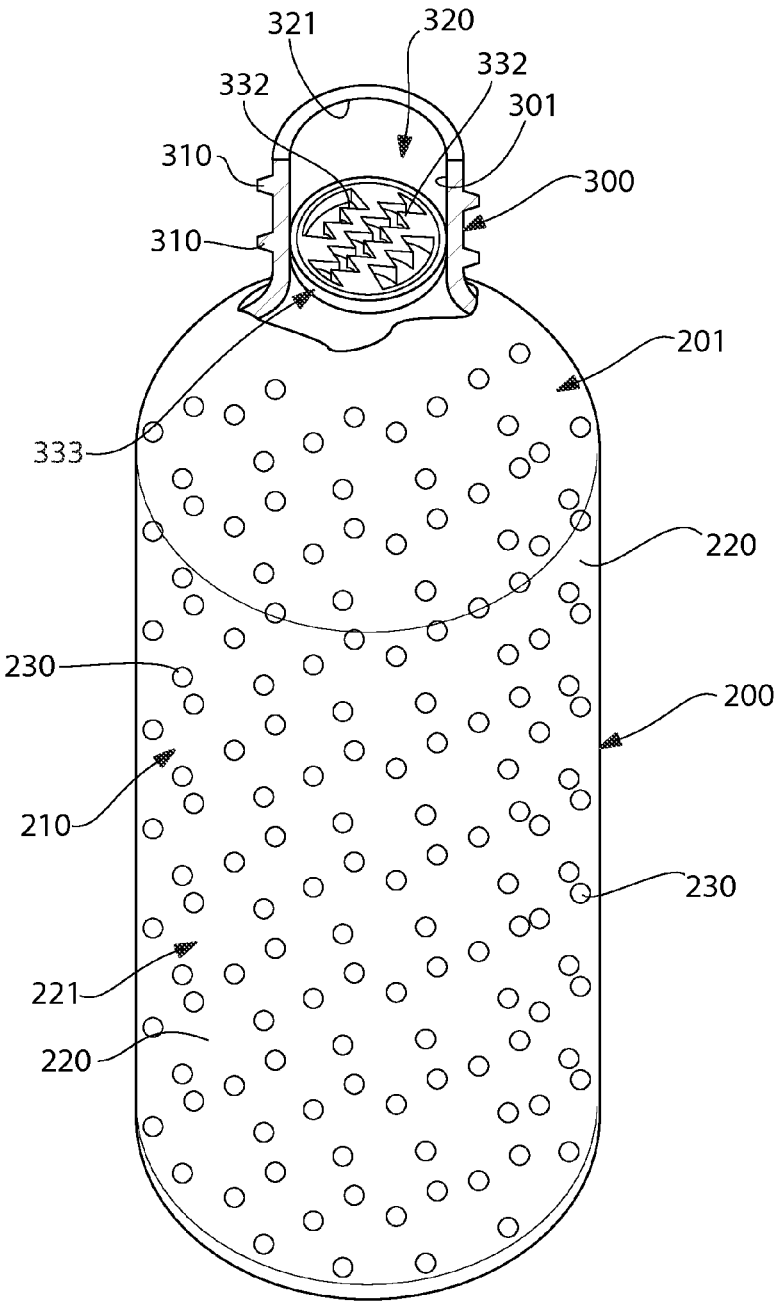
FIG. 2 is a perspective view of the dispenser of FIG. 1 with the cap removed and the dispensing conduit shown in partial cut-away to show the rupture member.
Figure 3:
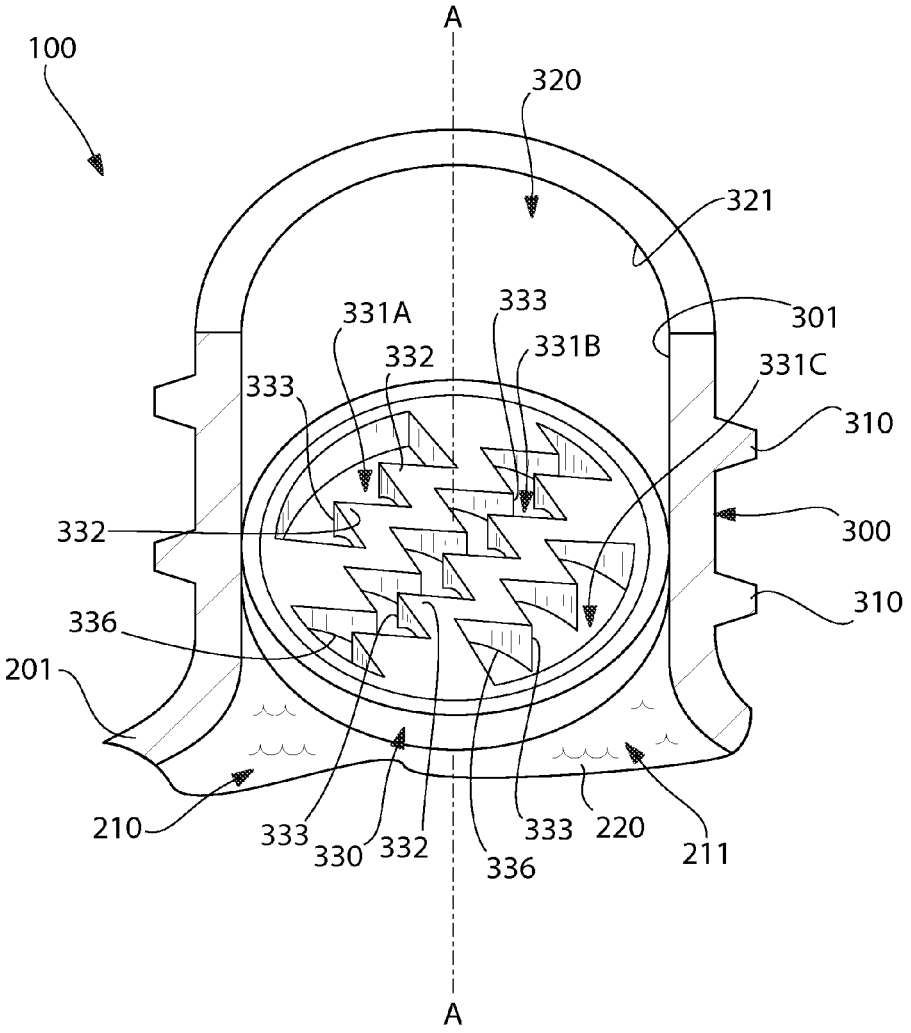
FIG. 3 is a close-up view of the dispensing conduit of FIG. 2.

Referring to FIGS. 1 and 2 concurrently, a dispenser 100 in accordance with one embodiment of the present invention is illustrated. The dispenser 100 generally comprises a body 200, a neck 300 and a cap 400 detachably coupled to the neck 300. In the exemplified embodiment, the neck 300 and body 200 are integrally formed. Of course, in alternate embodiments, the body 200 and the neck 300 can be separately formed components that are later joined together. The body 200 comprises a shoulder portion 201 that transitions the body 200 into the neck 300.

The neck 300 comprises external threads 310 that mate with internal threads (not shown) on the cap 400. The cap 400 is configured to enclose the top of the dispenser 100 and prevent spilling of the composition 211 from the dispenser 100. The cap 400 comprises a flip cap 401 that is adjustable between a closed position (illustrated in FIG. 1) and an open position (not illustrated). When the cap 401 is in the open position, at least a portion of an orifice 321 of the dispensing conduit 320 is unobstructed. Thus, when the flip cap 401 is in the open position, the composition 211 within the dispenser 100 can be dispensed from the orifice 321 of the dispensing conduit 320 for use, which is discussed in greater detail below. When the flip cap 401 is in the closed position, the orifice 321 is sealed, thereby preventing the composition 211 within the dispenser 100 from being dispensed from the orifice 321 of the dispensing conduit 320. It should be understood that a wide variety of caps and nozzles can be used with the dispenser 100 in accordance with the present invention, none of which are limiting unless specifically recited in the claims.

The body 200 forms a reservoir 210 containing the composition 211, which in the exemplified embodiment is a personal care product, such as a body wash, soap, or lotion. However, the intended use and/or exact nature of the composition 211 is not limiting of the present invention unless specifically recited in the claims. For example, in some embodiments, composition 211 could be laundry detergent, dish wash, or the like. The body 200 of the dispenser is compressible so that the composition 211 can be dispensed from the dispenser 100 via the dispensing conduit 320 when the user squeezes the body 200. In other embodiments, the body 200 may be incompressible and/or utilize different mechanisms of action and/or structural arrangements to dispense the composition from the dispenser 100 via the dispensing conduit 320. It is to be understood that the structural details and aesthetic design of the dispenser 100 can take on a wide variety of embodiments in accordance with the present invention and, thus, should not be considered limiting of the present invention unless specifically recited in the claims. As will become apparent from the discussion below, the present invention is directed to the ability of the dispenser 100 to rupture the beads 230 during the dispensing of the composition 211, irrespective of the type of dispenser used. For example, in certain other embodiments, the dispenser 100 may be, without limitation, a pump-type dispenser that utilizes a dip tube, a pump-type dispenser that utilizes piston, a collapsible dispenser, a pressurized gas dispenser, or combinations thereof. In such alternate embodiments, the dispensing conduit 320 could be located within the dip tube, within the nozzle, or within any fluid passageway through which the composition 211 must flow during the dispensing procedure.

The composition 211 comprises a first substance 220 and a plurality of beads 230 immersed in the first substance 220. In one embodiment, the first substance 220 is a liquid and the beads 230 are suspended within the first substance 220. In certain alternate embodiment, the first substance 220 may be a gas. Moreover, the first substance 220 may be a multi-fluid solution in certain embodiments. For example, the first substance 220 may be a liquid-liquid mixture, a liquid-gas mixture, or a gas-gas mixture. In other embodiments, the first substance 220 may be a flowable granular substance. In one embodiment, the first substance is a liquid soap. In other embodiments, the first substance 220 may be shampoo, conditioner, body wash, etc.

Figure 6:
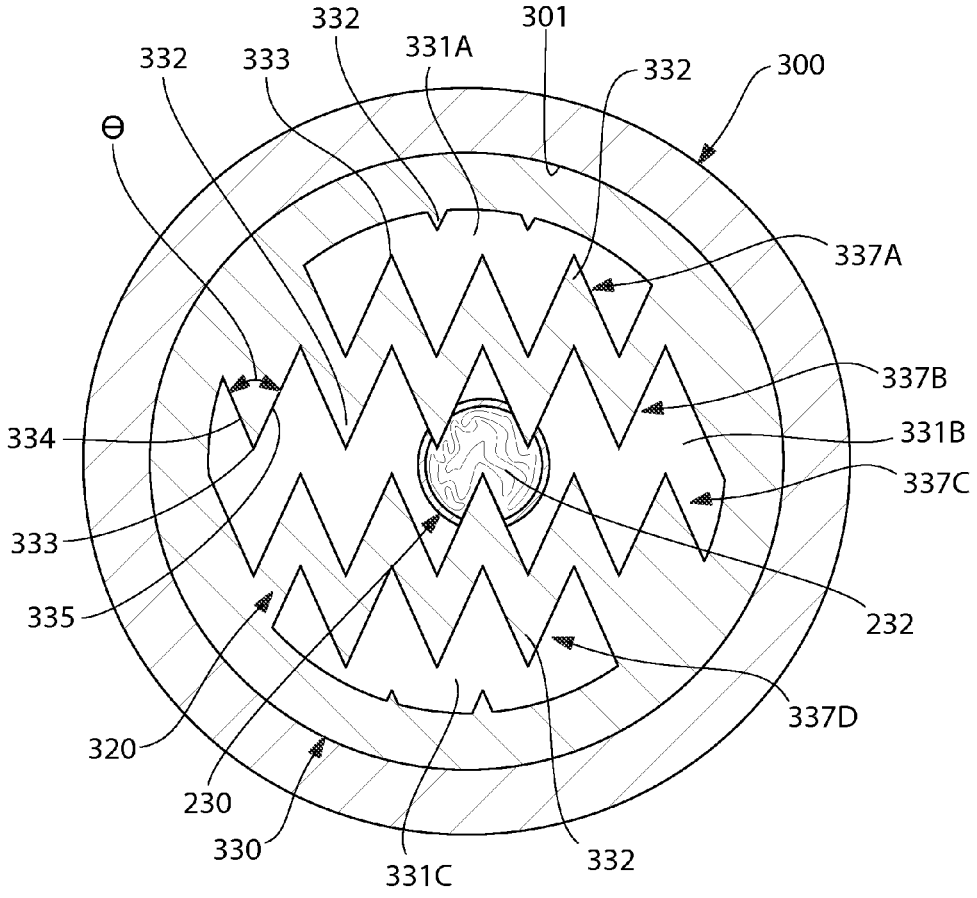
FIG. 6 is a transverse cross-sectional view of the dispensing conduit taken along view VI-VI of FIG. 5.

The beads 230 are capsule-like structures that comprise a shell 231 containing a second substance 232 therein (see FIG. 6). The shell 231 encapsulates and retains the second substance 232 therein, thereby preventing mixing of the second substance 232 with the first substance 220 within the reservoir 210. In other words, the shell 231 isolates the second substance 232 from the first substance 220 within the reservoir 210 and prior to dispensing of the composition 211. In the exemplified embodiment, the beads 230 are substantially spherical in shape. However, in other embodiments, the beads 230 may take on other three-dimensional shapes, including without limitation polygonal prisms, pyramids, cylinders, cones, ovoids, or combinations thereof. The invention is not to be limited by the shape of the beads 230 unless specifically recited in the claims.

The shell 231 of the bead 230 is a thin-walled shell that is rupturable upon application of sufficient mechanical force so that the second substance 232 is released from the bead 230 during dispensing of the composition 211 (discussed below in greater detail). In certain embodiments, the shell 231 can be formed of a gelatinous material, a synthetic polymer, a natural polymer, or combinations thereof. Of course, other materials can be used to form the shell 231 as desired. In one embodiment, the second substance 232 is a liquid. In certain alternate embodiment, the second substance 232 may be a gas. Moreover, the second substance 232 may be a multi-fluid solution in certain embodiments. For example, the second substance 232 may be a liquid-liquid mixture, a liquid-gas mixture, or a gas-gas mixture. In other embodiments, the second substance 232 may be a flowable granular substance. In one embodiment, the second substance 232 is a liquid soap, a liquid fragrance, or a powder. In one embodiment, the second substance 232 is a different color than the first substance 220. As used herein, transparent/clear, black and white are considered colors.

When the beads 230 are ruptured during the dispensing process (discussed below), the second substance 232 is released from the beads 230 and mixes into the first substance 220. In certain embodiments, the first and second substances 220, 232 can be active agents that are reactive with one another. Thus, the rupturing of the beads 230 during dispensing of the composition 211 begins the reaction between the first and second substances 220, 232 immediately prior to (and/or during) application of the composition 211 to the desired surface. In certain other embodiments, the first and second substances 220, 232 are different colors, thereby enhancing the visual aesthetics in the dispensed composition 211, such as providing a swirl and/or streak of the second substance 232 in the first substance 220.

Referring now to FIGS. 3-6 concurrently, an inner surface 301 of the neck 300 of the dispenser 100 defines a dispensing conduit 320 for dispensing the composition 211 from the reservoir 210. The dispensing conduit 320 extends along a longitudinal axis A-A from the reservoir 210 to the dispensing orifice 321. The dispensing conduit 320 is a passageway through which the composition 211 flows during the dispensing process. In the exemplified embodiment, the dispensing conduit 320 has a circular transverse cross-sectional profile having a diameter $D_1$. However, in other embodiments, the transverse cross-sectional profile of the dispensing conduit 320 can take on other shapes, such as polygons, ovals, or irregular shapes. Further, as mentioned above, the dispensing conduit 320 can be located in other locations other than the neck 300.

A rupture member 330 is disposed within dispensing conduit 320. In the exemplified embodiment, the rupture member 330 is a transverse plate affixed within the dispensing conduit 320. The rupture member 330 is oriented substantially normal to the longitudinal axis A-A of the dispensing conduit 320. In alternate embodiments, the rupture member 320 does not have to take on a plate-like form but can take on alternate structures, such as a dome, lattice structure, or mere projections extending from the surface that forms the dispensing conduit 320. Moreover, in other embodiments, the rupture member 330 can extend at an oblique angle with respect to longitudinal axis A-A of the dispensing conduit 320.

The rupture member 330 is preferably constructed of a hard plastic. Suitable hard plastics include polymers and copolymers of ethylene, propylene, butadiene, vinyl compounds and polyesters such as polyethylene terephthalate. The invention, however, is not so limited and the rupture member 330 may be constructed of any other material that would be suitable for rupturing the beads 230. In one embodiment, the rupture member 330 is integrally formed with the neck 300 of the dispenser 100. However, in other embodiments, the rupture member 330 may be a separate component that is disposed within the dispensing conduit 320 and fixed in position via any suitable technique, including thermal welding, adhesives, an interference fit, a snap-fit, a threaded interlock, or combinations thereof.

The rupture member 330 comprises a plurality of apertures 331A-C that form fluid passageways through the rupture member 330 for allowing the composition 211 to flow through the rupture member 330 and through the dispensing conduit 320. The rupture member 330 is positioned within the dispensing conduit 320 so that the composition 211 located within the reservoir 210 passes through the apertures 331A-C of the rupture member 330 upon being dispensed from the dispenser 100. Thus, the rupture member 330 acts as a flow-restrictor for the dispensing conduit 320 and can be referred to as such. While the exemplified embodiment of the rupture member 330 includes three apertures 331A-C, a greater or lesser number of apertures can be used as desired. However, as will be discussed in greater detail below, in order to increase the number of barbs 332 for rupturing the beads 230, it may be preferable to include at least two apertures 331 in certain embodiments of the rupture member 330.

The rupture member 330 further comprises a plurality of barbs 332 for rupturing the beads 230 of the composition 211 as the composition flows through the apertures 331A-C. In one embodiment, the barbs 332 are constructed of the same material as the rupture member 330 and are formed integrally therewith. In other embodiments, the barbs 332 may be formed of a different material, such as a metal or a different type of plastic, and affixed to the body of the rupture member 330 (or within the body that forms the dispensing conduit 320) at a later stage.

The barbs 332 extend transversely into the apertures 331A-C and are sharpened elements that can penetrate and rupture the beads 230 as the beads 230 flow through the apertures 331A-C. In the exemplified embodiment, the rupture member 330 comprises a plurality of the barbs 332 extending into each of the apertures 331A-C. In the exemplified embodiment, each of the barbs 332 terminate in a cutting edge 333. The cutting edges 333 are apexes formed by the intersection of the side-wall surfaces 334, 335 of the barbs 332 that are arranged at an acute angle θ relative to one another (shown in FIG. 6). The cutting edges 333 extend substantially parallel to the longitudinal axis A-A of the dispensing conduit 320 (shown best in FIG. 4). However, in other embodiments, the cutting edges 333 can extend at an oblique angle to the longitudinal axis A-A of the dispensing conduit 320. In still other embodiments, the barbs 332 may terminate in cutting points (not illustrated) rather than an elongate edge.

Figure 4:
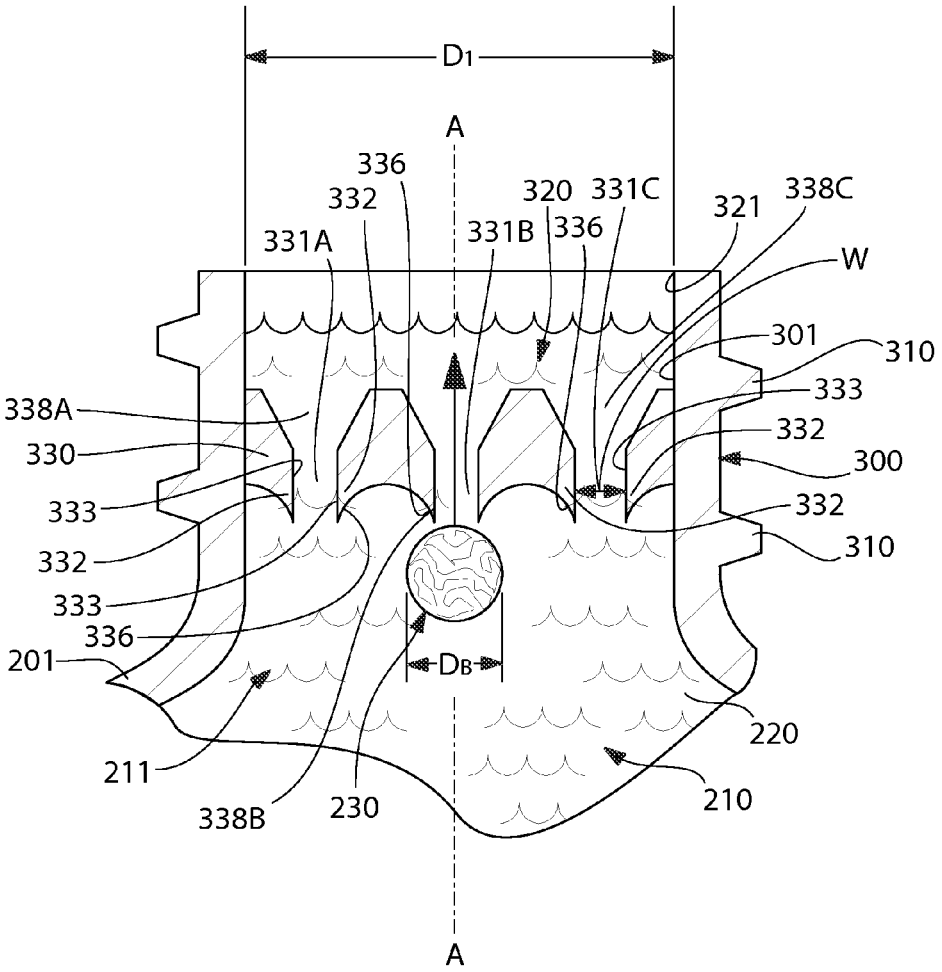
FIG. 4 is a longitudinal cross-sectional schematic of the dispensing conduit of the dispenser of FIG. 3 taken along the longitudinal axis A-A.

In the exemplified embodiment, each barb 332 comprises a concave sloped lower surface 336 (best shown in FIG. 4). However, in certain other embodiments, the lower surfaces 336 of the barbs 332 may be planar, convex, concave or combinations thereof.

In the exemplified embodiments, the barbs 332 are arranged to extend into the apertures 331A-C so as to form saw-toothed configurations 337A-D (FIG. 6) of the barbs 332. More specifically, the barbs 332 extending into the middle aperture 331B form a first saw-tooth configuration 337B of the barbs 332 and a second saw-tooth configuration 337C of the barbs 332. The first saw-tooth configuration 337B of the barbs 332 is opposite and offset from the second saw-tooth configuration 337C of the barbs 332. The arrangement, configuration, number and size of the apertures 331 and the barbs 332 on the rupture member 330 can take on a large number of variations in accordance with the present invention, some of which are exemplified in FIGS. 7-10. In some non-illustrated embodiments of the rupture member 330, a single barb 332 can extend into each aperture 331 and/or only a single aperture 331 can be utilized with one or more barbs 332.

Figure 5:
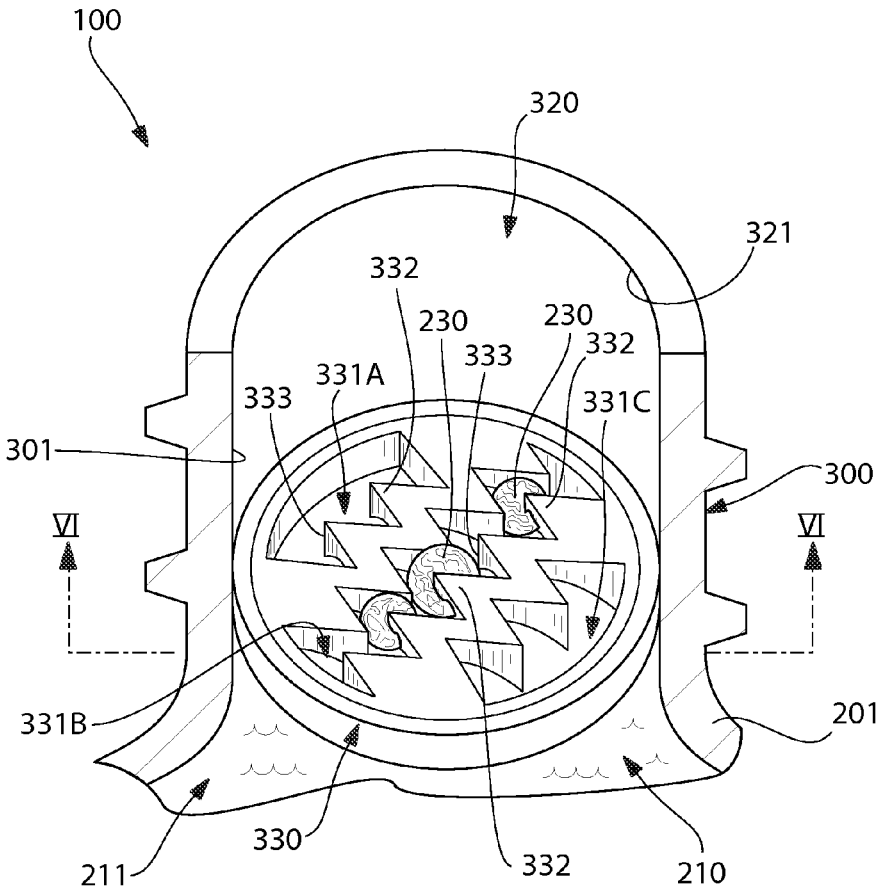
FIG. 5 is a perspective view of the dispensing conduit of FIG. 4 wherein beads are being ruptured by the rupture member in accordance with an embodiment of the present invention.

Referring now to FIGS. 4-6 concurrently, each of the apertures 331A-C are elongated transverse slots. In the exemplified embodiment, the apertures 331A-C are elongated slots having a jagged transverse cross-sectional profile due to the saw-tooth configurations 337A-D of the barbs 332. The invention, however, is not so limited and transverse cross-sectional profiles of the apertures 331A-C can take on many other shapes.

During use of the dispenser 100, the apertures 331A-C allow the composition 211 to flow therethrough for dispensing. The apertures 331A-C, however, are sized and shaped so that the beads 230 can not pass through the apertures 331A-C without contacting at least one of the barbs 332. As a result, as pressure forces the beads 230 through the apertures 331A-C, the barbs 332 rupture the shells 231 of the beads 230, thereby expelling the second substance 232 into the flow of the first substance 220. In order to ensure that the beads 230 do not pass through the apertures 231A-C without being ruptured by the barbs 332, the apertures 331A-C are designed to have transverse cross-sectional profiles (shown in FIG. 6) that do not allow the beads 230 to pass therethough in an unobstructed manner. This can be achieved, in one embodiment, by taking into consideration that each of the beads 230 will have a maximum transverse cross-sectional profile (shown in FIG. 6), which in the exemplified embedment is determined by the maximum diameter $D_B$ of the bead 230. With this in mind, the apertures 331A-C are design to have transverse cross-sectional profiles (shown in FIG. 6) such that the maximum transverse cross-sectional profile (shown in FIG. 6) of the beads 230 can not be overlaid atop the transverse cross-sectional profiles of the apertures 331A-C without at least one of the barbs 332 extending into the maximum transverse cross-sectional profile of the beads 230. In the example of FIG. 6, the middle aperture 331B has a transverse cross-sectional profile that results in three of the barbs 332 extending into the maximum transverse cross-sectional profile of the bead 230.

In certain other embodiments, the apertures 331A-C can be sized and shaped so that the beads 230 can not pass through the apertures 331A-C without being ruptured by the barbs 332 by controlling the width W (FIG. 4) of the apertures 331A-C relative to the maximum diameter $D_B$ of the beads 230. Specifically, the width W of the apertures 331A-C is designed to be less than the maximum diameter $D_B$ of the beads 230 at all points. Because the apertures 331A-C are the only path of egress for the composition 211 from the dispenser 100, the beads 332 will be ruptured by the barbs 332 prior to exiting the dispenser 100. The rupturing of the beads 230 is shown in FIG. 5 wherein the beads 230 are being forced into contact with the barbs 332 as the beads 230 flow through the dispensing conduit 320. It should be noted that the beads 230 are not all the same size in certain embodiments of the composition 211.

Despite desiring the rupture of the beads 230 during the dispensing procedure, the composition 211 must still be capable of flowing through the dispensing conduit 320 without requiring the application of excessive pumping force. As mentioned above, the dispensing conduit 320 has a transverse cross-sectional area at the location of the rupture member 330 which is dictated by the diameter $D_1$. In order to allow adequate flow of the composition 211 through the rupture member 330, the apertures 331A-C collectively define an open transverse cross-sectional area that is at least 35% of the transverse cross-sectional area of the dispensing conduit 320 in one embodiment. In a more particular embodiment, the plurality of apertures 331A-C collectively define an open transverse cross-sectional area that is between 40% to 80% of the transverse cross-sectional area of the dispensing conduit 320.

During operation of the dispenser 100, pressure is applied to the sides of the body 200 of the dispenser 100, thereby causing a pressure build-up within the reservoir 210 which forces the composition 211 through the dispensing conduit 320. As the composition 211 is forced through the dispensing conduit 320, the first substance 220 passes through the apertures 231A-C of the rupture member 330 carrying the beads 230 along therewith. Upon entering the apertures 331A-C, the shells 231 of the beads 230 are ruptured by the barbs 332 of the rupture member 330*m* thereby releasing the second substance 232. As the composition 211 continues through the dispensing conduit 320, the second substance 232 is mixed with the first substance 220 and is dispensed as a pre-formed mixture. In some embodiments, the mixture of the first and second substance 220, 232 is dispensed in stripes form. In other embodiments, the mixture of the first and second substance 220, 232 is not a homogeneous mixture. It should be noted that in embodiments where the dispensing conduit 320 is within a dip tube, the actuation of the pump will provide the pressure to induce flow of the composition 211.

Figure 7:
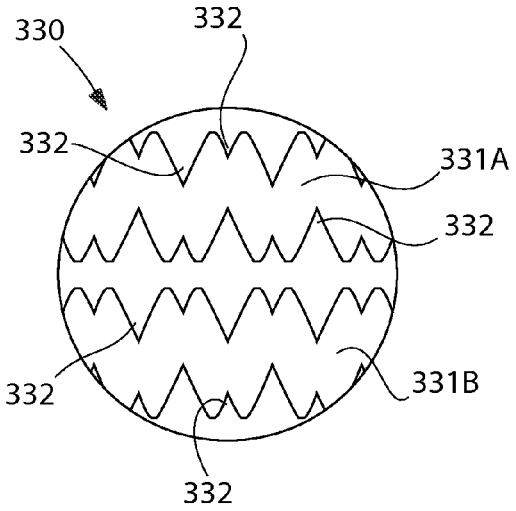
FIGS. 7-10 are top views of alternative embodiments of rupture members that can be used in the dispenser of FIG. 1 in accordance with other embodiments of the present invention.

Referring to FIG. 7, a first alternate embodiment of a rupture member 330 is illustrated. The rupture member 330 of FIG. 7 comprises two apertures 331A-B and a plurality of barbs 332 in saw-tooth configurations. As illustrated, each barb 332 disclosed in FIG. 7 are of one of two different lengths, the two different lengths of barbs 332 being staggered so that no two barbs 332 of the same size are located adjacent to each other. Further, the barbs 332 of the same length on opposite sides are offset from each other.

Figure 8:
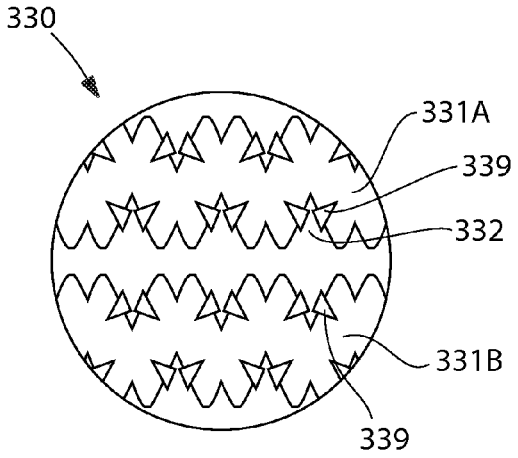

Referring to FIG. 8, a second alternate embodiment of a rupture member 330 is illustrated. The rupture member 330 of FIG. 8 is substantially similar to the rupture member 330 of FIG. 7, except that the rupture member 330 of FIG. 8 comprises secondary barbs 339 that are configured to aid in rupturing the shells 231 of the beads 230 that pass through the aperture 331.

Figure 9:
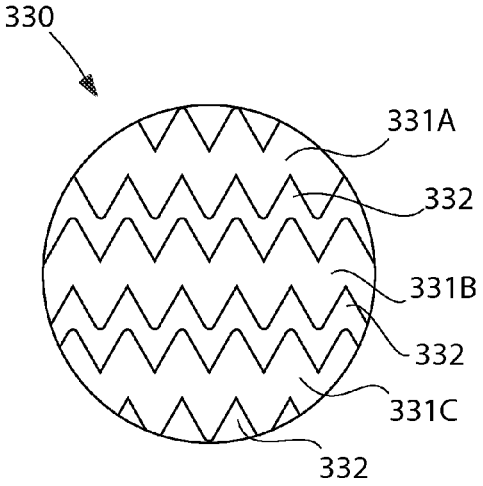

Referring to FIG. 9, a third alternate embodiment of a rupture member 330 is illustrated. The rupture member 330 of FIG. 9 comprises three apertures 331A-C and a plurality of barbs 332. Each of the apertures 331A-C comprises a first saw-tooth configuration of barbs 332 that is opposite and offset from a second saw-tooth configuration of barbs 332.

Figure 10:
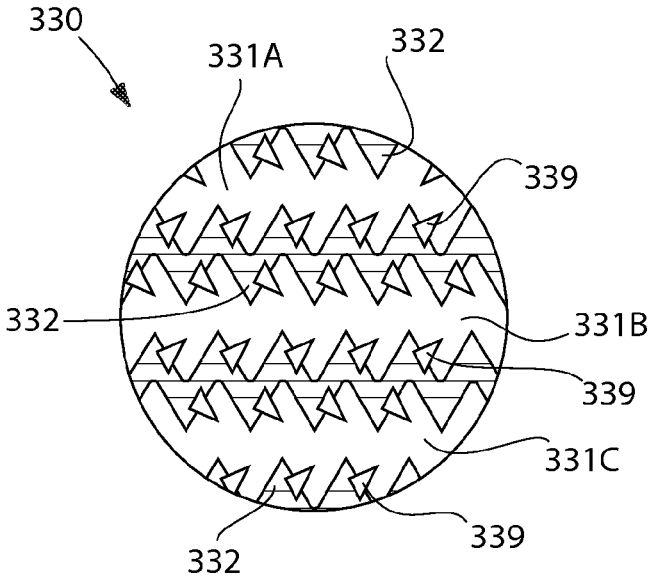

Referring to FIG. 10, a fourth alternate embodiment of a rupture member 330 is illustrated. The rupture member 330 of FIG. 10 is substantially similar to the rupture member 330 of FIG. 9 except that the rupture member 330 of FIG. 10 comprises secondary barbs 339 that are configured to aid in rupturing the shells 231 of the beads 230.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A dispenser comprising:

a reservoir containing a composition comprising a first substance and at least one bead immersed in the first substance, the at least one bead comprising a shell containing a second substance;

a dispensing orifice for dispensing the composition from the reservoir;

a dispensing conduit having a longitudinal axis and extending from the reservoir to the dispensing orifice and through which the composition flows; and a rupture member disposed within the dispensing conduit, the rupture member comprising at least one aperture and a plurality of barbs that at least partially defines a boundary of the at least one aperture, the plurality of barbs rupturing the shell of the at least one bead as the composition flows through the at least one aperture;

wherein the rupture member comprises a plate disposed transversely within the dispensing conduit;

wherein each of the plurality of barbs comprises a first sidewall surface and a second sidewall surface arranged at an acute angle relative to one another and a concave-sloped lower surface;

wherein each of the plurality of barbs terminates in a cutting edge having an acute apex formed at an intersection of the first sidewall surface and the second sidewall surface; and wherein the cutting edge of each of the plurality of barbs extends substantially parallel to the longitudinal axis of the dispensing conduit.

2. The dispenser according to claim 1 wherein the at least one aperture is sized and shaped so that the at least one head can not pass through the at least one aperture without contacting at least one of the plurality of barbs.

3. The dispenser according to claim 1 wherein the at least one bead has a maximum transverse cross-sectional profile, and the at least one aperture has a transverse cross-sectional profile, wherein the maximum transverse cross-sectional profile of the at least one bead can not overlay the transverse cross-sectional profile of the at least one aperture without at least one of the plurality of barbs extending into the maximum transverse cross-sectional profile of the at least one head.

4. The dispenser according to claim 1 wherein the dispensing conduit is located within a neck portion of the dispenser.

5. The dispenser according to claim 1 wherein the plurality of barbs are constructed of a different material than the rupture member.

6. The dispenser according to claim 1 wherein the at least one aperture comprises a funnel-shaped section for receiving the composition from the reservoir.

7. The dispenser according to claim 1 wherein the rupture member is constructed of a hard plastic.

8. The dispenser according to claim 1 wherein the rupture member is integrally formed with a neck portion of the dispenser.

9. The dispenser according to claim 1 wherein the plurality of barbs are arranged in at least one saw-toothed configuration.

10. The dispenser according to claim 9 wherein the plurality of barbs are arranged in a first saw-toothed configuration and a second saw-toothed configuration.

11. The dispenser according to claim 10 wherein the second saw-toothed configuration is opposite and offset from the first saw-toothed configuration.

12. The dispenser according to claim 1 wherein the at least one aperture is an elongated transverse slot.

13. A dispenser comprising:

a reservoir containing a composition comprising a first substance and a plurality of beads immersed in the first substance, each of the beads comprising a shell containing a second substance;

a dispensing orifice for dispensing the composition from the reservoir;

a dispensing conduit having a longitudinal axis and extending from the reservoir to the dispensing orifice and through which the composition flows; and a flow-restrictor disposed within the dispensing conduit, the flow-restrictor comprising a plurality of apertures and a plurality of barbs that at least partially define a boundary of each of the apertures, the barbs rupturing the shells of the plurality of beads as the composition flows through the plurality of apertures;

wherein the flow-restrictor comprises a plate disposed transversely within the dispensing conduit;

wherein each of the plurality of barbs comprises a first sidewall surface and a second sidewall surface arranged at an acute angle relative to one another and a concave-sloped lower surface; and wherein each of the plurality of barbs terminates in a cutting edge having an acute apex formed at an intersection of the first sidewall surface and the second sidewall surface.

14. The dispenser according to claim 13 wherein the dispensing conduit has a transverse cross-sectional area, and wherein the plurality of apertures collectively define an open transverse cross-sectional area that is at least 35% of the transverse cross-sectional area of the dispensing conduit.

15. The dispenser according to claim 14 wherein the open transverse cross-sectional area is between 40% to 80% of the transverse cross-sectional area of the dispensing conduit.

16. The dispenser according to claim 13 wherein each of the apertures is sized and shaped so that the beads can not pass therethrough without contacting the barbs.

17. The dispenser according to claim 13 wherein the beads have a maximum transverse cross-sectional profile, and each of the apertures has a transverse cross-sectional profile, wherein the maximum transverse cross-sectional profiles of the beads can not overlay the transverse cross-sectional profiles of the apertures without one or more of the barbs extending into the maximum transverse cross-sectional profiles of the beads.

18. The dispenser according to claim 13 wherein the flow restrictor comprises at least one saw-toothed configuration of the barbs extending into each of the plurality of apertures.

19. The dispenser according to claim 13 wherein the flow restrictor comprises a first saw-toothed configuration of the barbs and a second saw-toothed configuration of the barbs extending into an aperture.

20. The dispenser according to claim 19 wherein the second saw-toothed configuration of the barbs is opposite and offset from the first saw-toothed configuration of the barbs.

21. The dispenser according to claim 19 wherein the flow restrictor comprises the second saw-toothed configuration of the barbs and the first saw-toothed configuration of the barbs extending into a middle aperture.

22. The dispenser according to claim 13 wherein the dispensing conduit is located within a neck portion of the dispenser.

23. The dispenser according to claim 13 wherein each of the barbs is constructed of a different material than the flow-restrictor.

24. The dispenser according to claim 13 wherein each of the apertures comprises a funnel-shaped section for receiving the composition from the reservoir.

25. The dispenser according to claim 13 wherein each of the apertures is an elongated slot.

26. A dispensing apparatus comprising:

a dispensing conduit; and a flow-restrictor disposed within the conduit, the flow-restrictor comprising:

at least one aperture; and a plurality of barbs that at least partially define a boundary of the at least one aperture, wherein the barbs are arranged in at least one saw-toothed configuration;

wherein the flow-restrictor comprises a plate disposed transversely within the dispensing conduit; and wherein each of the barbs comprises a first sidewall surface and a second sidewall surface arranged at an acute angle relative to one another and a concave-sloped lower surface; and wherein each of the barbs terminates in a cutting edge having an acute apex formed at an intersection of the first sidewall surface and the second sidewall surface.

27. The dispensing apparatus according to claim 26 wherein the barbs are arranged in a first saw-toothed configuration and a second saw-toothed configuration, the second saw-toothed configuration of the barbs being opposite to and offset from the first saw-toothed configuration of the barbs.

28. The dispensing apparatus according to claim 26 wherein the flow-restrictor has an open transverse cross-sectional area that is between 40% to 80% of a transverse cross-sectional area of the dispensing conduit.

* * * * *